United States Patent [19]

Swarens

[11] Patent Number: 4,748,543

[45] Date of Patent: May 31, 1988

[54] HIDDEN SOURCE FLUORESCENT LIGHT WASH FIXTURE

[76] Inventor: Ralph W. Swarens, 417 W. Camino Real, Arcadia, Calif. 91006

[21] Appl. No.: 66,981

[22] Filed: Jun. 29, 1987

[51] Int. Cl.[4] ..... F21S 1/02

[52] U.S. Cl. ..... 362/147; 362/148; 362/219; 362/260; 362/341; 362/347; 362/365

[58] Field of Search ..... 362/145–148, 362/151, 153, 217, 219, 221, 225, 227, 235, 249, 260, 296, 341, 346–348, 33, 364, 365; 350/641

[56] References Cited

U.S. PATENT DOCUMENTS

| | | | |
|---|---|---|---|
| 4,229,779 | 10/1980 | Bilson et al. | 362/296 |
| 4,460,942 | 7/1984 | Pizzuti et al. | 362/217 |
| 4,564,888 | 1/1986 | Lewin et al. | 362/147 |

FOREIGN PATENT DOCUMENTS

| | | | |
|---|---|---|---|
| 67803 | 6/1981 | Japan | 350/641 |

*Primary Examiner*—Samuel Scott
*Assistant Examiner*—Noah Kamen
*Attorney, Agent, or Firm*—J. E. McTaggart

[57] ABSTRACT

An improved fluorescent indirect lighting fixture has its light source concealed from normal view by locating the lamps in a partially wrapped-around region to one side of an offset reflector, which is shaped in a special concave curvature to produce uniform "wall wash" illumination. A producible high quality reflective surface with required curvature maintained by a rigid, accurate reflector assembly is achieved by utilzing a thin flexible reflective lining of high purity aluminum conformally laminated against a rigid extruded aluminum reflector body of required curvature. Two-piece end plates provide lamp socket mountings, integral wiring conduits, reflective inner end surfaces, decorative trim at light-exit window ends and reflector body reinforcement. The complete reflector module including ballasts and a.c. power plug is easily installed, without tools, into a recessed builder's housing, firmly held with no exposed screwheads or other fastenings yet readily removeable for service due to a novel torsion spring retaining system. With the fixture in place, only the reflector surfaces and co-ordinated reflective trim, framing the light-exit window, are presented to normal view. Direct light, extraneous light and lamp images are virtually eliminated.

17 Claims, 3 Drawing Sheets

HIDDEN SOURCE FLUORESCENT LIGHT WASH FIXTURE

FIELD OF THE INVENTION

This invention relates to the field of lighting fixtures, more particularly to architecturally-oriented fluorescent lighting fixtures for uniformly illuminating selected flat surfaces in commercial and residential buildings.

BACKGROUND OF THE INVENTION

There is a long-standing and ongoing need for improvements in lighting fixtures designed especially for the purpose of providing architecturally distinctive indirect lighting treaments in both private and public buildings where it is desired to provide uniform illumination over a flat surface such as a wall, ceiling or floor, while subjectively concealing the light source, thus creating a restful artificially-lighted environment free of distraction and annoyance from extraneous high intensity direct light and glare.

Fluorescent lighting has become predominant in this field due to its high efficiency, reliability, economy and versatility.

Among the many existing indirect fluorescent lighting fixture configurations for "wall wash" effects, the category addressed by this invention utilizes a reflector of non-symmetrical concave cross-section having a trough region offset along one side, partially surrounding an elongated lamp, and concealing it from normal view, while projecting direct and reflected light thru an offset light-exit window in a pattern of light intensity distribution determined by the cross-sectional shape of the reflector and location of the lamp. Examples of such lighting fixtures are found in U.S. Pat. Nos. 4,383,289 to Lewen, No. 4,564,888 to Lewen et al, No. 4,517,631 to Mullins and No. 4,519,019 to Hall.

In a typical installation, a row of such lighting fixtures may be recessed into a ceiling a few feet out from a wall that is to be "washed". Two of the performance deficiencies to which this type of lighting is prone are: (a) non-uniform illumination, usually a noticeable decrease in illumination toward the lower portions of the wall due to the greater distance from the fixture and the sharper angle of light incidence and (b) a scalloping of the upper fringe of the illuminated area due to uneven combination of illumination from each of the adjacent fixtures.

Even when an optimum reflector shape has been developed to address items (a) and (b) above, many serious problems remain in designing the fixture for successful manufacture; for example, the need for a cost-effective, reproducible reflector configuration having a high-efficiency optical-quality surface, accurately shaped to the required special concave cross-sectional curvature, and having sufficient structural rigidity to maintain its shape.

A simple formed metal reflector is deficient both in surface quality and in rigidity, and the non-uniform curvature required precludes simple roll-forming. The use of extruded aluminum is a viable process providing acceptable rigidity, however, alloys suitable for extrusion inherently yield a very low grade reflective surface: attempting the required smoothing and polishing would be very difficult and costly, especially in view of the non-uniformity of reflective surface curvature. On the other hand, the special high-purity metal required for a good reflective surface would be unsuitable for the extrusion process, structurally weak and prohibitively expensive.

All exposed reflector parts and other fixture parts such as decorative trim must be designed for optical compatibility so as to minimize extraneous light reflections, light leaks or other anomalies which would detract from the fixture's elegance and effectiveness. In addition, for a recessed installation, the fixture requires an integral flush trim surround with no exposed fastenings such as screwheads, and must be made easy to install, securely retained in normal use, and yet easily accessed for service.

It is a primary object of the present invention to provide an improved lighting fixture of the fluorescent offset-reflector hidden-light-source wall-wash type capable of substantially uniform illumination of a nearby flat surface perpendicular to a mounting surface carrying a single fixture or multiple side-by-side fixtures.

It is a further object of this invention to provide in the configuration of the improved fixture a practical, easily manufactured and uniformly reproducible reflector assembly having an efficient high quality reflective surface, accurately shaped to provide a special designated cross-sectional concave curvature.

It is still a further object of this invention to provide a novel system of decorative trim framing and installation means which makes the reflector assembly easy to install, secure and attractive in normal use and readily accessable for service.

Still a further object is the development and definition of a unique sequence of steps in optimally manufacturing and installing the improved lighting fixture of this invention.

These objects have been achieved in the novel structure and method of manufacture of the improved lighting fixture of this invention hereby disclosed.

DETAILED DESCRIPTION

Figure 1:
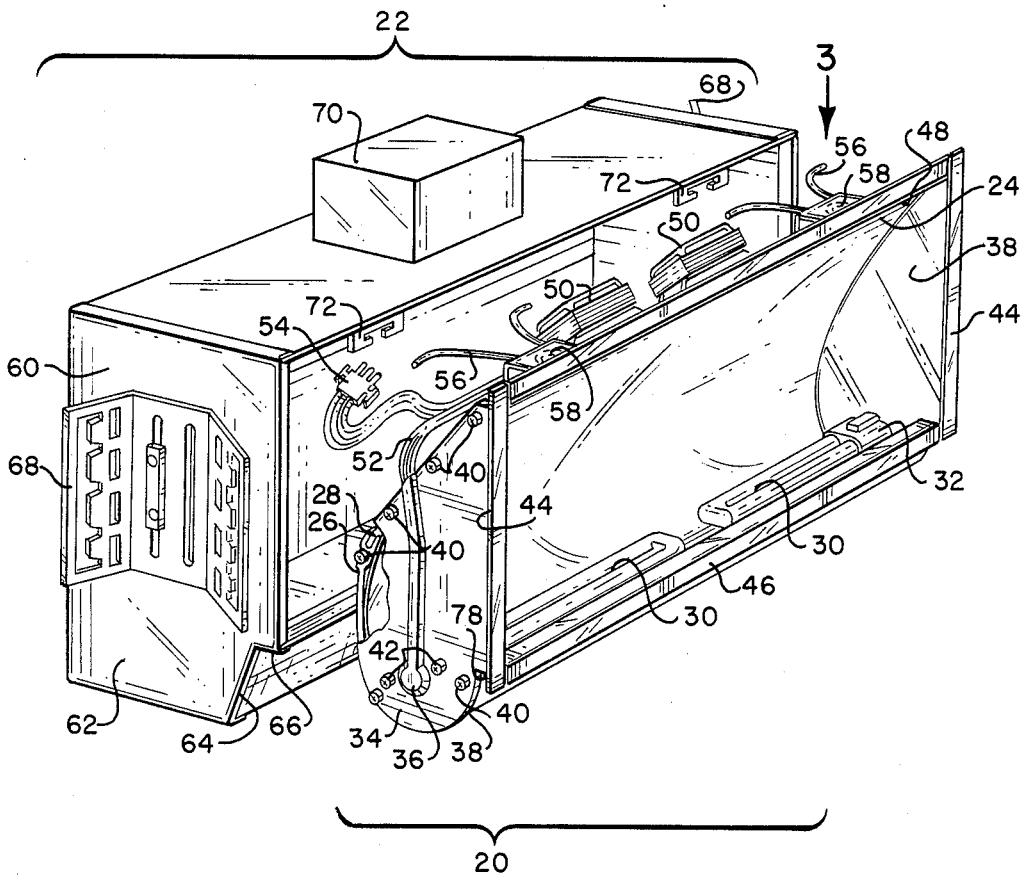
FIG. 1 is a perspective view of a lighting fixture in accordance with this invention in its preferred embodiment, with the reflector module shown separate from the housing.

In FIG. 1, which is a perspective view illustrative of the lighting fixture of this invention in its preferred embodiment, a reflector module 20 is shown separate from its housing 22. A reflective lining 24 is mounted conformally against the concave reflector mounting surface of a rigid extruded aluminum reflector body having an extension portion 26 and a surround portion 28 partially surrounding a pair of U-shaped fluorescent lamps 30 and associated sockets 32.

At each of the two perpendicular ends of the reflector body, an end cover 34, formed to provide a wiring tunnel 36, and an end reflector 38 having a reflective surface on its exposed side, are held in place against the ends of the extrusions 26 and 28 by screws 40, and two double-contact sockets 32 (only one visible in FIG. 1: at the right hand end) are each secured in place by a pair of screws 42, (only one pair visible in FIG. 1: at the left hand end) orienting the sockets 32 so as to locate the lamps 30 in a plane perpendicular to the light exit window as shown.

A light-exit window, bounded by the edges of the reflector body 26/28 and end reflectors 38, is framed by four trim strips: two side trim strips 44 formed as flanges on end reflectors 38, a surround-edge trim strip 46 having a right-angled cross-section, and an extension-edge trim strip 48 having an obtuse-angled cross-section. The surround-edge trim strip 46 is fastened against a reflector-body flange 78, part of extrusion 28.

The reflector module also includes a pair of fluorescent lamp ballasts 50, interconnected by electrical wiring harness 52 which is routed in part thru tunnels 36 to connect to lamp sockets 32 and which also connects to a 3-pin power plug 54. Immediately back of trim strip 48 are a pair of specially shaped 2-prong torsion springs 56 attached by spring tabs 58 to extrusion 26.

The basic housing box 60 is seen to be generally rectangular, having a protruding portion 62 with an angled wall 64 adjacent to a housing flange 66 at one edge of the light-exit window opening. Attached to housing box 60 are a pair of conventional builders' hanger brackets 68, one at each end, and a standard electrical connection box 70. A pair of special righ-angled retaining brackets 72, each having a T-shaped cutout, are located inside the housing box 60 as shown.

Figure 2:
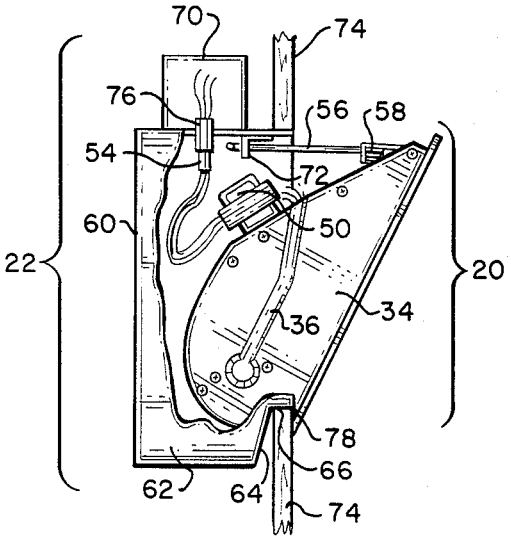
FIG. 2 is a partially cutaway end view showing the fixture in a pre-installation mode with the reflector module tilted relative to the housing.

In FIG. 2, a cutaway end view shows the reflector module 20 in a tilted position, in preparation for final installation into the housing 22, which is mounted into a wall 74. The 3-pin electrical plug 54 of reflector assembly 20 is shown plugged into a mating receptacle 76 which is mounted thru housing box 60 for entry to electrical box 70. The reflector-body flange 78, part of the surround extrusion 28, supports the reflector module 20 against housing flange 66 of housing box 60, forming a pivot which enables the module 20 to be tilted rotationally from the position shown, during installation and removal. It is seen that housing flange 66 serves as a wall cutout liner at one edge of an opening in wall 74, while the top panel of box 60 serves as a wall cutout liner at the opposite edge. Two torsion springs 56 each engage a retaining bracket 72 to retain the reflector module 20 in the tilted position shown.

Figure 3:
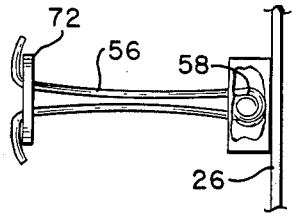
FIG. 3 is a top view showing a reflector-mounted torsion spring engaging a corresponding housing-mounted retainer bracket in the pre-installation mode corresponding to FIG. 2.

FIG. 3 is a top view of one of the two torsion spring retainer systems showing a cross-section of retaining bracket 72 with its T-shaped cutout engaged by the prongs of torsion spring 56 which is attached to extrusion 26 by spring tab 58: these items are shown in the pre-installation mode corresponding to FIG. 2.

Figure 4:
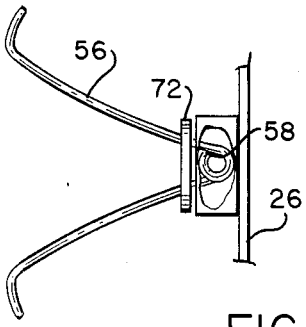
FIG. 4 shows the disposition of the elements of FIG. 3 in the final installation mode corresponding to FIG. 5.
Figure 5:
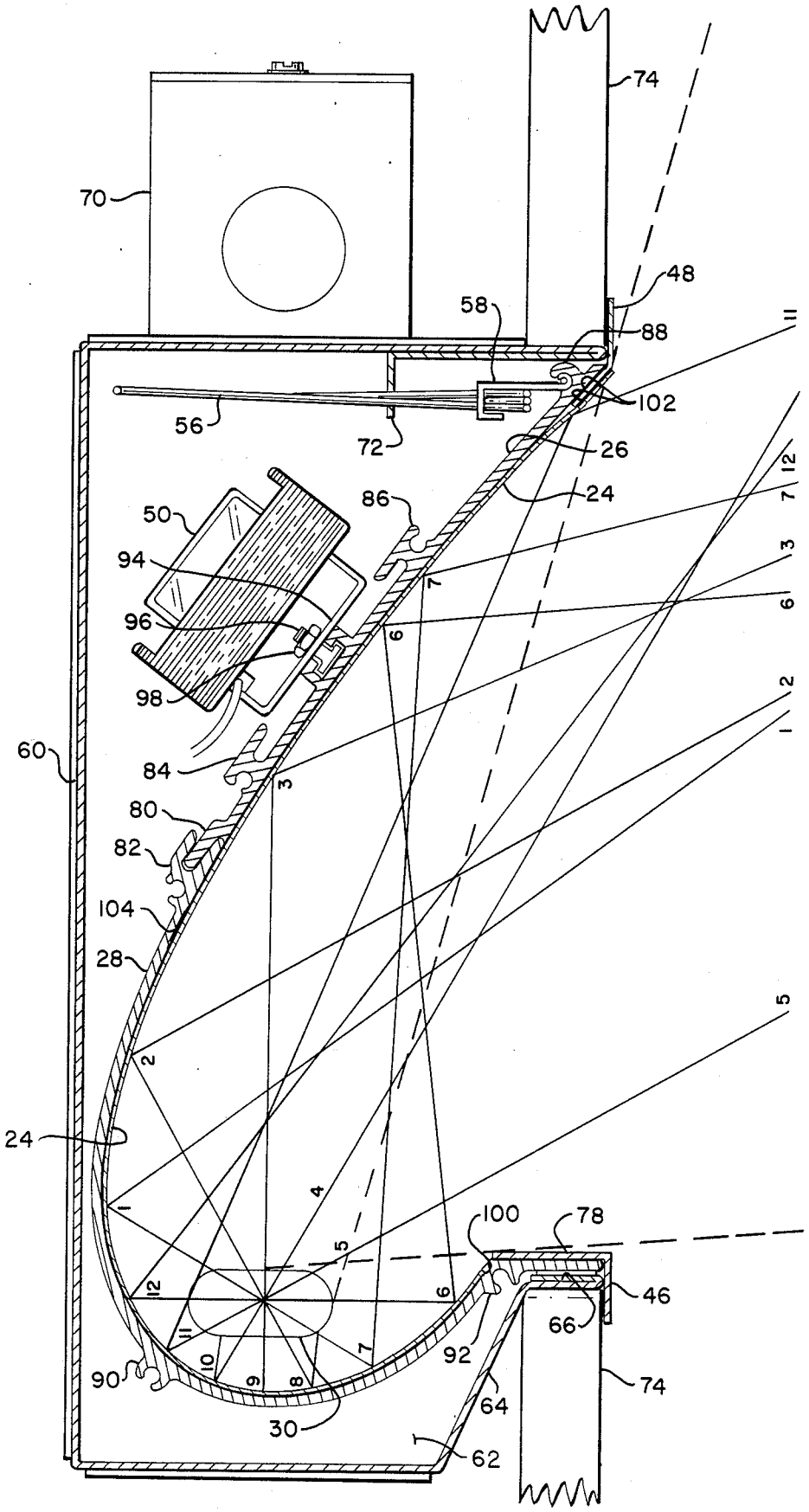
FIG. 5 is a cross-sectional view of the fixture of FIG. 1 with the reflector module in final installation mode, showing a set of basic light path patterns.

FIG. 4, which is also a top view of the items shown in FIG. 3, shows the disposition of these items after the reflector module 20 has been pushed from the position of FIG. 2 to a fully installed position within housing 22 as shown in FIG. 5. It will be noted that an installed fixture presents a uniform overall finished appearance since all of the exposed surfaces have a reflective finish, including the curved reflective surface 24, the two end reflectors 38 and their integral side trim strips 44 (refer to FIG. 1), the extension-edge trim strip 48, and the surround-edge trip strip 46.

The cross-sectional view of FIG. 5 shows the reflector mounting body made up from extension extrusion 26 and surround extrusion 28 mated together by a tongue 80 on extrusion 26 engaging a groove formed by the flange of boss 82 on extrusion 28. Bosses 82, 84, 86, 88, 90 and 92, extruded as part of the reflector body extrusions 26 and 28, contain slotted round keyways whose ends serve to engage screws 40 (refer to FIG. 1).

A rectangular boss 94 in extrusion 26 provides a T-shaped keyway for retaining heads of four ballast mounting screws 96 which, with four nuts 98, mount two ballasts 50. The neighboring bosses 84 and 86 include flanges which may be utilized to dress and retain electric wiring.

The reflective lining 24 is affixed conformally against the concave surface of the reflector mounting body, one edge of lining 24 abutting a shallow step 100 at the edge of extrusion 28. Lining 24 surrounds the lamps 30 and extends to the edge of extrusion 26, where the flange of trim strip 48 is sandwiched between lining 24 and top extrusion 26 and retained by two strips of double-sided adhesive tape 102, one on each side the flange of trim strip 48. Lining 24 is further retained in its mid-region against extrusion 28 by a strip of double-sided adhesive tape 104.

At the surround edge, reflector body trim strip 46 is fastened to sill flange 78 which is extruded as part of extrusion 28 and rests against housing flange 66 which is folded to double thickness as part of housing box 60. The housing flange 66 serves as a liner against the cutout edge of wall 74, and is made about $\frac{5}{8}$" wide to accommodate typical wall thickness. This sill configuration, formed by the stacked combination of the housing flange 66, the reflector-body flange 78 and the sill trim strip 46, is an important feature in the optical/mechanical effectiveness of this invention: it contributes to illumination uniformity by avoiding a compromise in the shape of the reflector at this edge, and avoids having to make the vertical portion of trim strip 46 excessively wide to conceal the wall cutout, which must normally be cut squared-off as shown since an angled edge is not feasable in most wall materials.

At the extended edge is seen spring tab 58 which is held captive in the keyway of boss 88, and which retains torsion spring 56, which in turn engages the T-shaped cutout in retainer bracket 72. The reflective surface 24 is seen to have a continuously concave cross-sectional shape, approximating the letter J (reversed in this view); the shape is generally elliptical in the surround region which is backed by extrusion 28, transitioning smoothly to become generally parabolic in the extended region which is backed by extrusion 26. The location of lamps 30 relative to the reflective surface 24 and their orientation perpendicular to the light window as shown accomplishes optimal illumination uniformity as well as lamp concealment.

FIG. 5 also shows the paths of 12 rays of light 30 degrees apart, numbered clockwise, originating from a central point of lamps 30. The dotted lines indicate the approximate boundaries of the of illumination produced.

Figure 6:
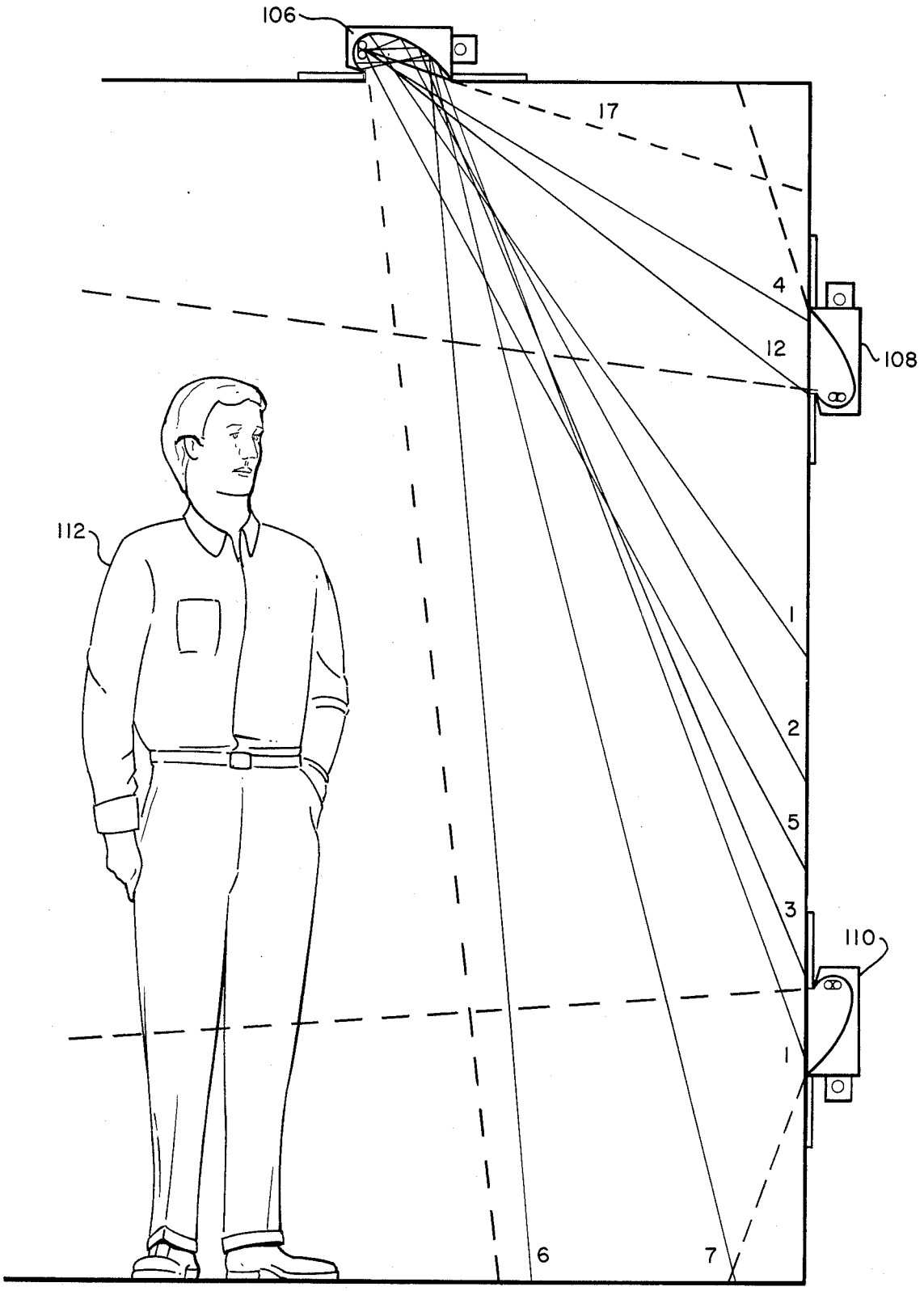
FIG. 6 is a cross-sectional view of a room showing the illumination range of fixtures in two typical wall locations and in a ceiling location, and also showing the basic light path patterns for the ceiling-mounted fixture, in extension of the light path patterns of FIG. 5.

FIG. 6 is a scaled cross-sectional view of a room with an eight foot ceiling height showing the range of illumination produced by lighting fixtures of this invention installed in three typical room locations: fixture 106 in the ceiling, which may be plastered or panelled, approximately three feet from the wall and oriented to illuminate the wall, fixture 108 six feet high on the wall and oriented to illuminate the ceiling, and fixture 110 two feet high on the wall, oriented to illuminate the floor. These three fixture locations are shown combined for purposes of illustrating typical locations; particular installations may utilize one, two or all three of the locations shown, as well as other potential locations.

The lines drawn from the ceiling-mounted fixture 106 are extensions of the light rays developed in FIG. 5, showing the paths of nine numbered dominant light rays exiting the fixture, as well as the illumination boundaries as indicated by the dotted lines. Apart from a small shaded strip close to the ceiling, the wall becomes "washed" with illumination of fairly uniform intensity from top to bottom since the reflector shape and lamp location tend to concentrate the angular distribution of the light rays more toward the lower portions of the wall, compensating for the greater distance and smaller angle of incidence.

Similarly fixture 108 will "wash" the ceiling, and fixture 110 will "wash" the floor with illumination bounded by the associated dotted lines.

A room occupant 112 standing (or sitting) in the location indicated would not perceive any direct light from any of the three fixtures since their lamps are all concealed by the sill edge of the light-exit window of each fixture; in fact the occupant would perceive no glare and only very low levels of light intensity in the vicinity of the fixtures themselves since the shape and high quality of the reflecting surfaces and construction of the fixtures virtually eliminate reflected lamp images and effectively suppress extraneous reflected light.

The aluminum extrusions 26/28, FIG. 5, are made to have approximately 0.1" wall thickness, which along with the support provided by the end plates and bosses provides a rigid backing for the reflector lining 24 which is a very flexible sheet of high purity aluminum having a thickness of 0.012", supplied with its premium reflective side protected by a peel-off plastic film which is not removed until after final fixture installation.

The end covers 34 are press-formed from 0.03" sheet steel. End reflectors 38 and trim strips 46 and 48 are formed from 0.032" aluminum having one polished reflective side.

The housing box 60 is fabricated from 22 gauge sheet steel. Retaining brackets 72 are formed from 0.030" steel are are spot-welded in place. The electrical box 70 if fastened to housing box 60 by machine screws which may be retained by wing nuts inside the housing box 60. Receptacle 76 snaps in place, to be wired by conventional electrical connections including a ground wire.

The assembled housing 22 is customarily delivered separately to the construction site to be "roughed" into the building structure, and may be fastened in place by conventional builders' hardware such as hangers 68, which may optionally be fastened by means of additional adaptive hardware (not shown) attached to one or both ends of housing box 60. Power line wiring to electrical box 70 is conventional. Installation is intended to be in conformance with applicable building codes.

The following sequence has been found to best facilitate pre-assembly of the reflector module 20:

First a pair of end plate are assembled, each having an end cover 34, an end reflector 38 and a lamp socket 32, all held together by screws 42, with the socket wired and its wiring running thru the channel 36 of end cover 34.

Then a cleaned and deburred reflector mounting body is prepared, in this case by joining a pair of extrusions 26 and 28 using the tongue 80 and the groove formed by the flange of boss 82, to form a mounting body 26/28.

The ends of mounting body 26/28 are fastened temporarily by screws 40 to a pair of "dummy" end plates, which may be end covers 44 with no sockets assembled to them.

Then trim strip 48 is fastened in place with its flange affixed to the edge of extrusion 26 by means of a strip of double-sided adhesive tape 102.

A second strip of double-sided adhesive tape is affixed against the exposed side of the flange of trim strip 48, without removing the peel-off covering on the exposed side of the tape.

Similarly a third strip of tape 104 is affixed against the concave side of extrusion 28 near its edge, also without removing the peel-off tape covering on the exposed side.

The reflective lining 24 is then placed into position starting at the sill edge of extrusion 28, where the edge of the lining 24 is aligned against the step 100 in the extrusion.

With the lining 24 held in place against the major portion of extrusion 28, the covering is peeled off from tape 104 and the lining 24 is then pressed into place against tape 104 to thus affix lining 24 to extrusion 28.

The covering is peeled off from tape 102 on the flange of trim strip 48 and the free edge of the lining 24 is pressed into place and affixed against the flange of trim strip 48 which becomes sandwiched between the lining 24 and the edge of extrusion 26.

One of the temporary end plates 34 is removed and replaced by one of the pre-assembled final end plate assemblies, the heads of four ballast retaining bolts 96 are slid into the T-shaped keyway of boss 94 on extrusion 26, two spring tabs 58, each assembled to a torsion spring 56, are slid into the keyway of boss 88, then the second temporary end cover 60 is removed and replaced by the second pre-assembled end plate assembly.

Each of the two ballasts 50 is placed over a pair of captive bolts 96, slid along the keyway of boss 94 to its proper location, then fastened in place by nuts 98; then ballasts 50, lamp sockets 32 and power plug 54 are wired together with wiring harness 52.

The sill trim strip 46 is then affixed against the sill surface of extrusion 24. At this point, the completed reflector module 20 is packed ready for shipment to the installation site.

At the installation site the reflector module 20 is installed into housing 22 by (a) inserting plug 54 of the reflector module 20 into receptacle 76 of the housing 22 (refer to FIG. 2), (b) inserting the reflector module 20 partially into housing 22 in a tilted position as shown in FIG. 2 with reflector module extrusion sill 78 urged against housing sill 66, (c) compressing together the prongs of each of the two torsion springs 56 by hand and inserting the ends into the T-shaped cutouts in retaining brackets 72 of housing 22, as shown in FIG. 3, (d) pressing the reflector module 20 into the housing 22: the prongs of torsion springs 56 will slide thru the T-shaped cutouts in brackets 72, expanding apart under torsion to take the position shown in FIG. 4, where their expanded position retains the reflector module 20 in place in its final installation position as shown in FIG.

5 with the trim strips 44, 46 and 48 against the outer surface of the wall 74, (e) peeling off the protective film from the reflector lining 24, and (f) installing a pair of fluorescent lamps 30 into sockets 32, completing the installation.

The shape of the prongs and the torsion strength of springs 56 are designed to hold the reflector assembly 20 firmly in place and yet be capable of easy removal for maintenance purposes in a reversal of steps (a), (b), (c) and (d).

The preferred embodiment described specifies rough-in dimensions of 7"×16¾"×4", with outside trim dimensions of 7½"×17".

In an alternative embodiment, which uses only one lamp, one lamp socket and one ballast, the cross-sectional details are essentially identical with those of the preferred embodiment, but the length has been shortened to provide rough-in dimensions of 7"×8½"×4" and outside trim dimensions of 7½"×8⅞". The end plate carrying the lamp socket 32 is made identical with an end plate of the preferred embodiment as described, however in the single lamp embodiment, the second end reflector differs in that socket mounting holes are unnecessary and are therefore omitted to provide a finished appearance.

The lamps utilized are 120 volt PL/13 watt type (#213 PLWW). The U-shaped configuration of these lamps facilitates socket mounting in the end plates as described above, however other successful embodiments have utilized the well-known straight tubular lamps, which are particularly useful in creating longer fixtures of the same cross-sectional shape, where standard lamp lengths of 2', 4' and 8' may be utilized individually or placed end to end in combination to provide customized fixture lengths in 2' multiples.

The aluminum reflector mounting body has been extruded in two parts 26 and 28 in the preferred embodiment in view of known extruding capabilities and available equipment, however it may be deemed feasable to extrude the reflector body in one piece.

Similarly, there may be viable adhesive means alternative to the use of double-sided adhesive tape for affixing the reflective lining 24 and trim strips 46 and 48.

This specification is intended to encompass these and all of the numerous other configurations, variations in materials and dimensions, derivatives and alternative embodiments of which this invention is susceptable and which may become apparent to those of skill in the lighting fixture art without departing from the spirit and principles of the novel features and advantages of the present invention.

What is claimed is:

1. An improved fluorescent lighting fixture of the offset-reflector concealed-lamp type for uniformly illuminating a flat surface such as wall, floor or ceiling of a room while minimizing user-perceptable extraneous light in the region of the fixture itself comprising, (a) a rigid reflector mounting body, defining a reflector mounting surface having a continuously concave cross-sectional shape approximating the letter J, the shape remaining constant along its length between perpendicular ends forming an offset trough-shaped lamp-surround portion adjoining a gradually-curved extension portion, (b) a thin flexible sheet metal liner having a smooth highly reflective surface on one side its other side being affixed conformally against the concave mounting surface of said reflector mounting body, forming, in combination with said reflector mounting body, a reflector assembly having two opposite curved edges, one at each end, a straight surround edge and straight extension edge, (c) a pair of end plates one attached to each end of said reflector body, each end plate having a straight free edge which, in combination with the two straight edges of said reflector assembly, forms a rectangular light-exit window, (d) at least one U-shaped fluorescent lamp located within the surround region of said reflector assembly, substantially parallel to said reflective surface, said lamp being retained in place and electrically connected by a double-contact lamp socket mounted in one of said end plates and oriented so as to place said lamp in a plane approximately perpendicular to said light-exit window, and (e) integral with said reflector mounting body at its surround edge, a reflector-body flange extending away from said lamp in a plane substantially parallel with the plane of said lamp, providing a support member for said reflector mounting body, said lamp being located to the side of the flange plane which faces away from said extension portion;

whereby direct and reflected light rays from said lamp are directed thru said light-exit window in a selected spatial density pattern as predetermined by the concave cross-sectional shape of the reflector assembly and the positioning of said lamp relative to said reflective surface.

2. The invention as in claim 1 wherein the cross-sectional shape of said reflective surface, in conformity with said reflector mounting body, forms a continuously concave curve having a generally elliptical shape in the lamp-surround portion, transitioning smoothly to a generally parabolic shape in the extension portion, said lamp being mounted at a focal location within the lamp-surround region so as to produce substantially uniform illumination over a targeted flat surface area perpendicular to the plane of the light-exit window, while direct light and images of said lamp are concealed from ordinary observation by obstruction introduced by the surround edge of said light-exit window.

3. The invention as in claim 1 wherein each of said end plates is made to have a reflective surface on its inward-facing side.

4. The invention as in claim 1 wherein each of said end plates comprises a structural metal outer end cover laminated against a metal end reflector having a reflective surface on its inwardly-facing exposed side.

5. An improved fluorescent lighting fixture of the offset-reflector concealed-lamp type for uniformly illuminating a flat surface such as wall, floor or ceiling of a room while minimizing user-perceptable extraneous light in the region of the fixture itself, comprising:

(a) a rigid reflector mounting body, defining a reflector mounting surface having a continuously concave cross-sectional shape, approximating the letter J, the shape remaining constant along its length between perpendicular ends, forming an offset trough-shaped lamp-surround portion, adjoining a gradually-curved extension portion, (b) a thin flexible sheet metal liner having a smooth highly reflective surface on one side, its other side being affixed conformally against the concave mounting surface of said reflector mounting body, forming, in combination with said reflector mounting body, a reflector assembly having two opposed curved edges, one at each end, a straight surround edge and a straight extension edge, (c) a pair of end plates, one attached to each end of said reflector body, each end plate having a straight free edge which, in combination with the two straight edges of said reflector assembly, forms a rectangular light-exit window, each end plate comprising a structural metal outer end cover laminated against a metal end reflector having a reflective surface on its inwardly-facing exposed side, further comprising, in at least one of said end plates, an integral U-shaped channel formed in said end cover, and enclosed by said end reflector, said channel, thusly enclosed, functioning as an electrical wiring conduit extending from a socket pickup location to an exit location along an edge of the end plate, (d) a reflector-body flange, disposed along the surround edge of said reflector mounting body, extending from the surround edge of the reflector mounting surface to the plane of the light-exit window, said reflector-body flange being perpendicular to the plane of the light-exit window and having a width approximating the thickness of a typical wall, providing a support member for said reflector mounting body, and (e) elongated fluorescent lamp means located within the surround region of said reflector assembly, substantially parallel to said reflective surface, said lamp means being retained in place and electrically connected by lamp socket means;

wherein the cross-sectional shape of said reflective surface, in conformity with said reflector mounting body, forms a continuous concave curve having a generally parabolic extension region transitioning smoothly to a generally elliptical offset lamp-surround region, said lamp means being mounted therein at a focal location so as to produce substantially uniform illumination over a targeted flat surface area perpendicular to the plane of the light-exit window, whereby direct and reflected light rays from said lamp means are directed thru said light-exit window in a selected spatial density pattern as predetermined by the concave cross-sectional shape of the reflector assembly and the positioning of said lamp means relative to said reflective surface, while direct light and images of said lamp are concealed from ordinary observation by obstruction introduced by the surround edge of said light-exit window.

6. The invention as in claim 5 wherein said reflector mounting body is extruded from aluminum.

7. The invention as in claim 6 wherein said reflector mounting body comprises a lamp surround extrusion part having a grooved longitudinal edge, and an extension extrusion part having a tongued longitudinal edge engaging the grooved edge of the surround extrusion part, whereby the two parts are mated together so as to provide a continuous reflector mounting surface of designated concave cross-sectional curvature.

8. The invention as in claim 6 wherein said reflector body further comprises, on the side opposite the concave reflector mounting surface, a plurality of parallel longitudinal bosses, integral with said extrusions, each boss having a C-shaped cross-section defining a slotted circular keyway whereby said end plates are fastened against the ends of said extrusions by self-tapping screws engaging the ends of the keyways.

9. The invention as in claim 8 wherein the light-exit window is decoratively framed by trim means comprising;

(a) a sill-edge trim strip having an L-shaped cross-section with a wide flange and a narrow flange, the wide flange being affixed to the reflector body along its sill strip so as to display the narrow flange as decorative trim along the sill edge of the light-exit window, (b) an extension-edge trim strip having a first flange sandwiched between the reflector lining and the reflector mounting surface at the extension edge of the reflector body, and a second flange forming an obtuse angle with the first flange, displayed as decorative trim along the extension edge of the light-exit window, and (c) a pair of flanges formed one on each of said end reflectors, displayed as decorative trim at the two end edges of the light-exit window.

10. The invention as in claim 9 wherein all exposed surfaces of said trim means are made to have a reflective surface, whereby, as an appearance feature, when the fixture is recessed into a wall, all of its exposed parts display uniform reflective surfaces.

11. The invention as in claim 6 further comprising lamp ballast means mounted onto said reflector assembly, an electric power plug, and electrical wiring interconnecting said ballast means, said lamp socket means and said power plug.

12. The invention as in claim 12 further comprising a housing, designed for recessed installation into a rectangular opening, dimensioned to accept the light-exit window of said reflector assembly, in a wall or ceiling of a building, said housing being in the general form of a rectangular box.

13. The invention as in claim 12 wherein said fluorescent lamp means comprise two U-shaped fluorescent lamps, said lamp socket means comprise a pair of lamp sockets, one mounted to one of said end plates, and the other mounted to the other of said end plates and said ballast means comprise a pair of ballast units, one connected electrically to one of said lamp sockets and the other connected electrically to the other of said lamp sockets.

14. The invention as in claim 13 further comprising a pair of two-pronged torsion retaining springs, each attached to said mounting body by a tab made captive within a keyway in a boss extruded as part of said mounting body, prongs of said springs being shaped and disposed so as to slidably engage a T-shaped cutout in a retaining bracket, one bracket being mounted near each end of said housing box and located so as to allow the prongs of each of said torsion retaining springs to spread under torsion and thus enable retention of said reflector module in a fully-installed position within said housing, as well as easy removal therefrom, without any need for exposed fastening hardware such as screw-heads.

15. The invention as in claim 12 wherein said fluorescent lamp means comprises a U-shaped fluorescent lamp, said lamp socket means comprises a lamp socket mounted onto one of said end plates, and said ballast means comprises a ballast unit connected to said lamp socket.

16. The invention as in claim 15 further comprising a two-pronged torsion retaining spring, attached to said mounting body by a tab made captive within a keyway in a boss extruded as part of said mounting body, prongs of said spring being shaped and disposed so as to slidingly engage a T-shaped cutout in a retaining bracket mounted near one end of said housing box and located so as to allow the prongs to spread apart under torsion and thus enable retention of said reflector module in a fully-installed position within said housing, as well as easy removal therefrom, without any need for exposed fastening hardware such as screwheads.

17. A method of assembling a reflector module for a fluorescent lighting fixture of the indirect, hidden source, "wall wash" type, comprising the following sequential steps:

(a) assembling a pair of end plates, including lamp socket means and electrical wiring means, (b) attaching a pair of temporary end covers onto the ends of an extruded aluminum reflector mounting body having a concave mounting surface defining a surround region and an extension region, using self-tapping screws, (c) affixing a flange of a flanged trim strip against the reflector mounting body, along an edge of the mounting surface in the extension region, using double-sided adhesive tape, (d) affixing two strips of double-sided adhesive tape, one against the exposed side of the trim strip flange and the other onto a mid-region of the mounting surface, keeping peel-off protective film on the exposed side of the two tapes, (e) placing a thin flexible reflector lining conformally against the mounting surface, starting with an edge of the lining aligned against a shallow step provided at the edge of the mounting surface in the surround region of the reflector mounting body, (f) peeling off the protective film from the mid-region tape and affixing the lining conformally against the mounting surface in that region, (g) peeling off the protective film from the tape on the trim flange and affixing the lining conformally against the mounting surface and the flange along the extension edge, with the trim strip being held in place with its flange sandwiched between the reflective lining and the mounting surface, (h) removing the two temporary end covers and fastening one of the two assembled end plates onto one end of the reflector mounting body using self-tapping screws, (i) sliding the heads of ballast mounting screws into a T-shaped keyway provided in a boss extruded as part of the aluminum mounting body, then fastening ballast means to the body using the screws, (j) sliding torsion spring retaining means into a keyway provided in a boss extruded as part of the aluminum mounting body, (k) fastening the second assembled end plate onto the second end of the mounting body, using self-tapping screws, (l) electrically interconnecting the lamp socket means and ballast means together with a power plug, and (m) affixing a flanged sill trim strip to a sill extruded as part of the mounting body at its surround region edge, using double-sided adhesive tape.

* * * * *